US009839999B2

(12) United States Patent
Kittell

(10) Patent No.: US 9,839,999 B2
(45) Date of Patent: Dec. 12, 2017

(54) EMBEDDED ELEMENT PULLING APPARATUS

(75) Inventor: Jason W. Kittell, Morrisville, VT (US)

(73) Assignee: Happiness Tool Co., Inc., Morrisville, VT (US)

( * ) Notice: Subject to any disclaimer, the term of this patent is extended or adjusted under 35 U.S.C. 154(b) by 1871 days.

(21) Appl. No.: 13/136,425

(22) Filed: Aug. 1, 2011

(65) Prior Publication Data

US 2013/0032769 A1 Feb. 7, 2013

(51) Int. Cl.

| | |
|---|---|
| ***B25C 11/00*** | (2006.01) |
| ***B25B 7/02*** | (2006.01) |
| ***B25B 5/12*** | (2006.01) |
| ***B25B 7/14*** | (2006.01) |

(52) U.S. Cl.

CPC ..... *B25C 11/00* (2013.01); *B25B 5/122* (2013.01); *B25B 7/02* (2013.01); *B25B 7/14* (2013.01)

(58) Field of Classification Search

USPC ..... 254/18; 269/271, 266, 43

See application file for complete search history.

(56) References Cited

U.S. PATENT DOCUMENTS

| | | | | |
|---|---|---|---|---|
| 401,113 | A * | 4/1889 | Baumeister | B25C 11/00 254/20 |
| 442,426 | A * | 12/1890 | Donnelly | B25B 7/02 30/349 |
| 452,752 | A * | 5/1891 | Stewart | B25C 11/00 254/20 |
| 470,595 | A | 3/1892 | Pomeroy | |
| 925,557 | A * | 6/1909 | Bramstadt | B25C 11/00 254/108 |
| 1,141,741 | A * | 6/1915 | Wiseman | B25C 11/00 24/537 |
| 1,141,742 | A * | 6/1915 | Wiseman | B25C 11/00 254/18 |

(Continued)

FOREIGN PATENT DOCUMENTS

| | | |
|---|---|---|
| JP | 04152073 A | 5/1992 |
| JP | 04331079 A | 11/1992 |
| JP | 05008184 A | 1/1993 |

OTHER PUBLICATIONS

Leslie Gordon, Inventor's Corner: Air-powered retractor pulls out nails almost instantly, Machine Design, Sep. 23, 2010, Penton Media, Inc.

*Primary Examiner* — Joseph J Hail
*Assistant Examiner* — Alvin Grant
(74) *Attorney, Agent, or Firm* — Thomas G. Ference

(57) ABSTRACT

An embedded element pulling apparatus, the apparatus comprises a pair of linear guides separated by a width, each linear guide having a length and an inner guide surface, the inner guide surface angled to form a closing ramp at the grasping end. A jaw is paired with each linear guide; each jaw is engaged to follow along the inner guide surface. Each jaw may have an interchangeable grasping tooth. A lock assembly is integrated to lock and unlock the jaws. A carriage cooperatively couples the jaws and the lock assembly. A positioning actuator engages with the carriage to position the jaws along the length of the linear guides and a drive actuator engages with the carriage to close the jaws, pull the embedded element, and open the jaws. A motive device may drive the positioning actuator and drive actuator.

37 Claims, 15 Drawing Sheets

(56) References Cited

U.S. PATENT DOCUMENTS 1,445,908 A * 2/1923 Perkins ..... A47J 45/10 81/347
1,516,155 A * 11/1924 Santarelli ..... B25C 11/02 254/18
1,892,082 A * 12/1932 Shekerjian ..... B25B 7/02 254/21
2,477,956 A * 8/1949 Brady ..... B25C 11/00 227/63
2,570,914 A 10/1951 Buck
2,570,915 A * 10/1951 Buck ..... B25C 11/02 254/18
2,639,887 A * 5/1953 Henry ..... B25C 11/02 254/19
2,691,505 A * 10/1954 Hursh ..... E01B 29/26 254/18
2,709,570 A 5/1955 Henry
2,735,649 A * 2/1956 Swallert ..... B25C 11/02 254/18
2,752,625 A * 7/1956 Ponsell ..... A47J 45/10 15/143.1
2,797,889 A * 7/1957 Talboys ..... E01B 29/26 254/18
2,846,187 A * 8/1958 Sublett ..... E01B 29/26 254/18
3,176,551 A * 4/1965 Hansen ..... B25B 7/04 269/263
3,249,334 A * 5/1966 Sheperd ..... E01B 29/26 112/30
3,481,641 A * 12/1969 Berger ..... G04D 1/02 294/100
3,643,918 A * 2/1972 Ellis ..... B25C 11/02 254/19
3,807,718 A * 4/1974 Sendoykas ..... B25B 5/122 269/228
3,883,118 A * 5/1975 Miller ..... E01B 29/26 254/18
3,978,576 A * 9/1976 Mustoe, Jr. ..... B25C 11/02 254/18
4,007,913 A * 2/1977 Aldrich ..... B25C 11/02 254/18
4,237,946 A 12/1980 Leitner
4,538,793 A * 9/1985 Dieringer ..... E01B 29/26 254/18
4,987,634 A * 1/1991 Weihrauch ..... A47K 11/10 15/145
5,163,598 A 11/1992 Peters et al.
5,253,844 A 10/1993 Cotic et al.
5,407,243 A * 4/1995 Riemann ..... A01M 3/00 294/100
5,537,727 A * 7/1996 Mayer ..... B25B 27/10 29/237
5,924,679 A * 7/1999 Wilson ..... B25C 11/02 254/18
6,098,960 A 8/2000 Lefavour et al.
6,106,041 A * 8/2000 Eckhardt ..... A61B 17/50 294/99.2
6,113,073 A 9/2000 Lefavour et al.
6,220,126 B1 * 4/2001 Domenge ..... B25B 7/04 81/418
6,364,288 B1 * 4/2002 Laughlin ..... B25C 11/02 254/18
6,695,288 B2 2/2004 Benitez et al.
6,711,789 B2 * 3/2004 Ping ..... B25B 5/06 24/499
6,941,626 B2 * 9/2005 Johnson, Jr. ..... B25B 7/123 29/237
7,156,004 B1 * 1/2007 Whitehead ..... B25B 7/02 81/420
7,353,757 B2 * 4/2008 Eldridge ..... E01B 29/26 104/17.1
8,485,103 B2 * 7/2013 Miller ..... E01B 29/26 104/17.2
9,032,598 B2 * 5/2015 Eldar ..... B25B 27/10 269/3
2008/0044792 A1 * 2/2008 Roberts ..... A61C 3/14 433/159

* cited by examiner

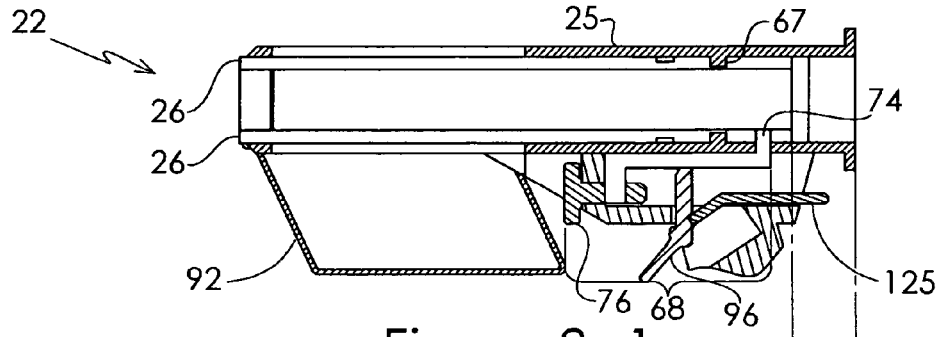
Figure 8a1
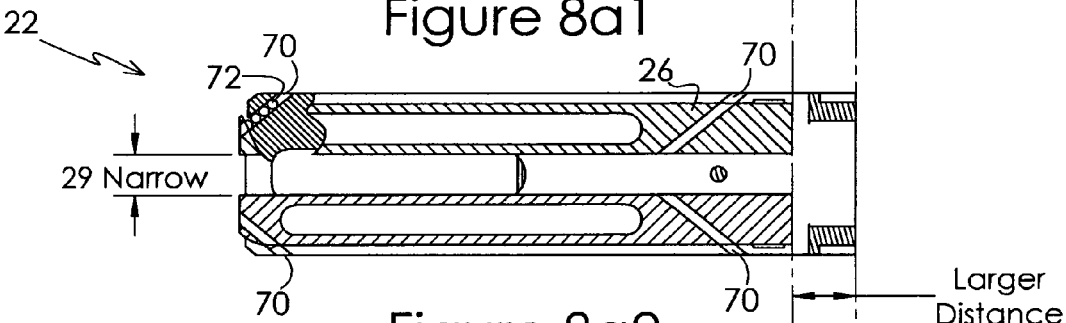
Figure 8a2
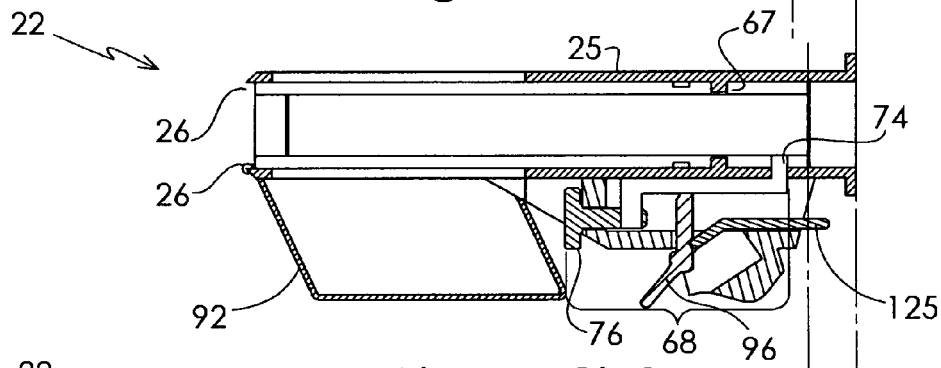
Figure 8b1
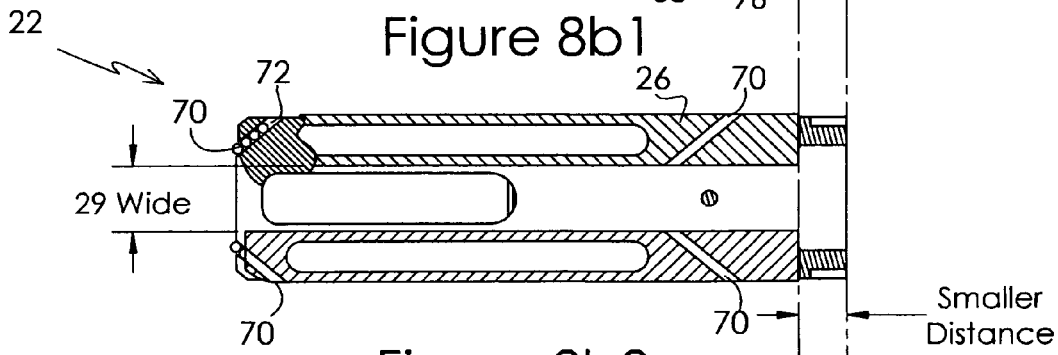
Figure 8b2

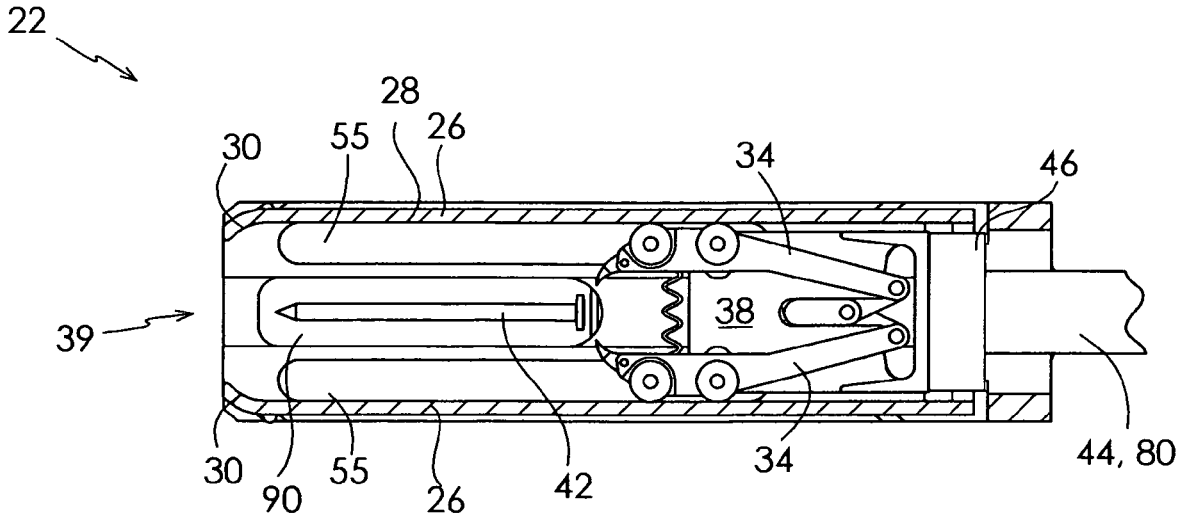
22
28
26
30
55
34
46
39
38
30
90
55
26
42
34
44, 80

EMBEDDED ELEMENT PULLING APPARATUS

FIELD

The present invention generally relates to an embedded element pulling apparatus. More specifically it relates to an embedded element pulling apparatus having a pair of jaws for grasping an embedded element, each jaw is coupled to a linear guide, and the pair of jaws is driven along the linear guides by a motive device to grasp, remove and release the embedded element.

BACKGROUND

Removing nails from wood is a common occurrence in the building trades. In most situations the craftsman needs to only remove a few nails that may have been driven into the wood improperly or whose removal is required to adjust for a minor modification to the structure being built. For these situations the use of the claws of a hammer or a crowbar is sufficient to remove the nails. However, in certain situations such as a major renovation or during the disassembling and moving a structure (barn or house) to a new location, hundreds or even thousands of nails may need to be removed. Usually in these situations preserving the integrity of the wood for reuse is also important. Using a hammer or crowbar to remove a large number of nails is time consuming and can result in significant damage to the wood. The current disclosure provides for a new tool that greatly reduces the time and effort of pulling nails as well as minimizes the damage to the wood. Given the high cost of lumber, recycling the materials of an entire building is also possible with this new tool. The proposed embedded element pulling apparatus further has embodiments that allow the apparatus to remove staples, screws and other embedded elements from a wide variety of materials.

SUMMARY

One aspect of the present disclosure is directed to an embedded element pulling apparatus having a grasping end. The apparatus comprises a pair of linear guides separated by a width, each linear guide having a length and an inner guide surface, the inner guide surface angled to form a closing ramp at the grasping end. A jaw is paired with each linear guide, each jaw is engaged to follow along the inner guide surface. A lock assembly is integrated to lock and unlock the jaws. A carriage cooperatively couples the jaws and the lock assembly. A positioning actuator engages with the carriage to position the jaws along the length of the linear guides and a drive actuator engages with the carriage to close the jaws, pull the embedded element, and open the jaws.

Another aspect of the present disclosure is directed to an embedded element pulling apparatus having teeth associated with each jaw that are interchangeable to vary the precision of how the embedded element is grasped and the type of embedded elements that may be removed.

Another aspect of the present disclosure is directed to an embedded element pulling apparatus having a width adjustment assembly for adjusting the width between the pair of linear guides to adjust for the size of the embedded element and gripping strength desired to grip the embedded element during removal.

Yet another aspect of the present disclosure is directed to an embedded element pulling apparatus having a receptacle for collecting removed embedded elements.

Still another aspect of the present disclosure is directed to an embedded element pulling apparatus having a motive device coupled with the jaws to pull the embedded element between grasping and un-grasping positions. The motive device is interchangeable with other motive devices that operate using mechanical, electric, magnetic, hydraulic, pneumatic and explosive principles to accommodate to different work environments.

Still yet another aspect of the present disclosure is directed to a motive device comprising a tube. The tube includes a tube wall, a tube interior, a tube exterior, opposite tube ends and a longitudinal axis. A tube end cap is proximate each tube end, each tube end cap has a large radius section and small radius section. Each large radius section is mounted to the interior of the tube so that each small radius section extends outward to form a valve gap between the tube wall and each small radius section. A pressure reservoir surrounds the tube exterior. The pressure reservoir has a reservoir end cap paired with each valve gap. Each reservoir end cap has a valve element fitting within each valve gap. A piston positioned within the tube's interior is movable along the longitudinal axis between the tube end caps. A trigger moves the pressure reservoir along the longitudinal axis relative to the tube allowing fluid to pressurize one side of the piston while venting the other side of the piston to move the piston. The valve element switches connection of the tube between exhaust and the pressure reservoir.

BRIEF DESCRIPTION OF DRAWINGS

The foregoing and other aspects and advantages of the invention will be apparent from the following detailed description, as illustrated in the accompanying drawings, in which:

FIG. 8*a*1 is a side, sectional view of the linear guides of FIG. 7*a* along line 8*a*1-8*a*1 adjusted to a narrow width;

FIG. 8*a*2 is top, plan, partial cutaway view of the linear guides in FIG. 7*b* along line 8*a*2-8*a*2 adjusted to a narrow width;

FIG. 8*b*1 is a side, sectional view of the linear guides of FIG. 7*a* along line 8*b*1-8*b*1 adjusted to a wide width;

FIG. 8*b*2 is top, plan, partial cutaway view of the linear guides in FIG. 7*b* along line 8*b*2-8*b*2 adjusted to a wide width;

FIG. 11*d* is a top sectional view of the grasping assembly of FIG. 11*a* along line A-A indicating a third step in grasping and removing an embedded element;

FIG. 11*e* is a top sectional view of the grasping assembly of FIG. 11*a* along line A-A indicating a fourth step in grasping and removing an embedded element;

FIG. 11*f* is a top sectional view of the grasping assembly of FIG. 11*a* along line A-A indicating a fifth step in grasping and removing an embedded element;

DETAILED DESCRIPTION

Figure 1A:
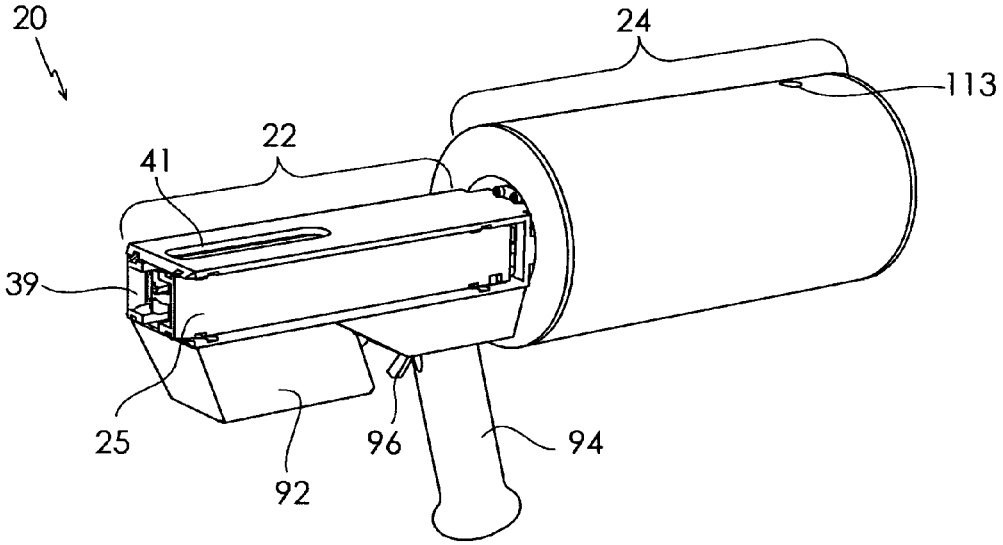
FIG. 1*a* is a perspective view of an embedded element pulling apparatus according to one embodiment of the invention that shows the grasping assembly integrated with a motive device.
Figure 1B:
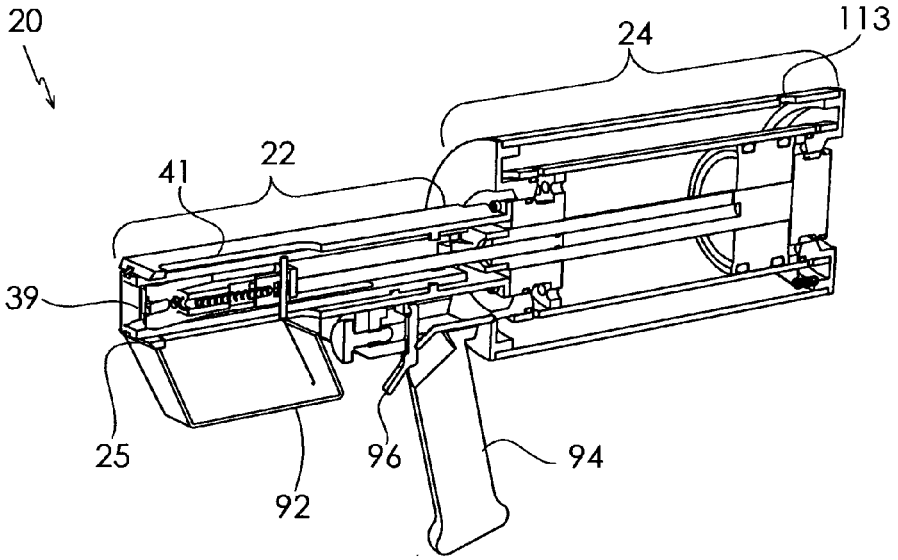
FIG. 1*b* is a sectional, perspective view of the embedded element pulling apparatus in FIG. 1*a*, with hatching left off for clarity.
Figure 2:
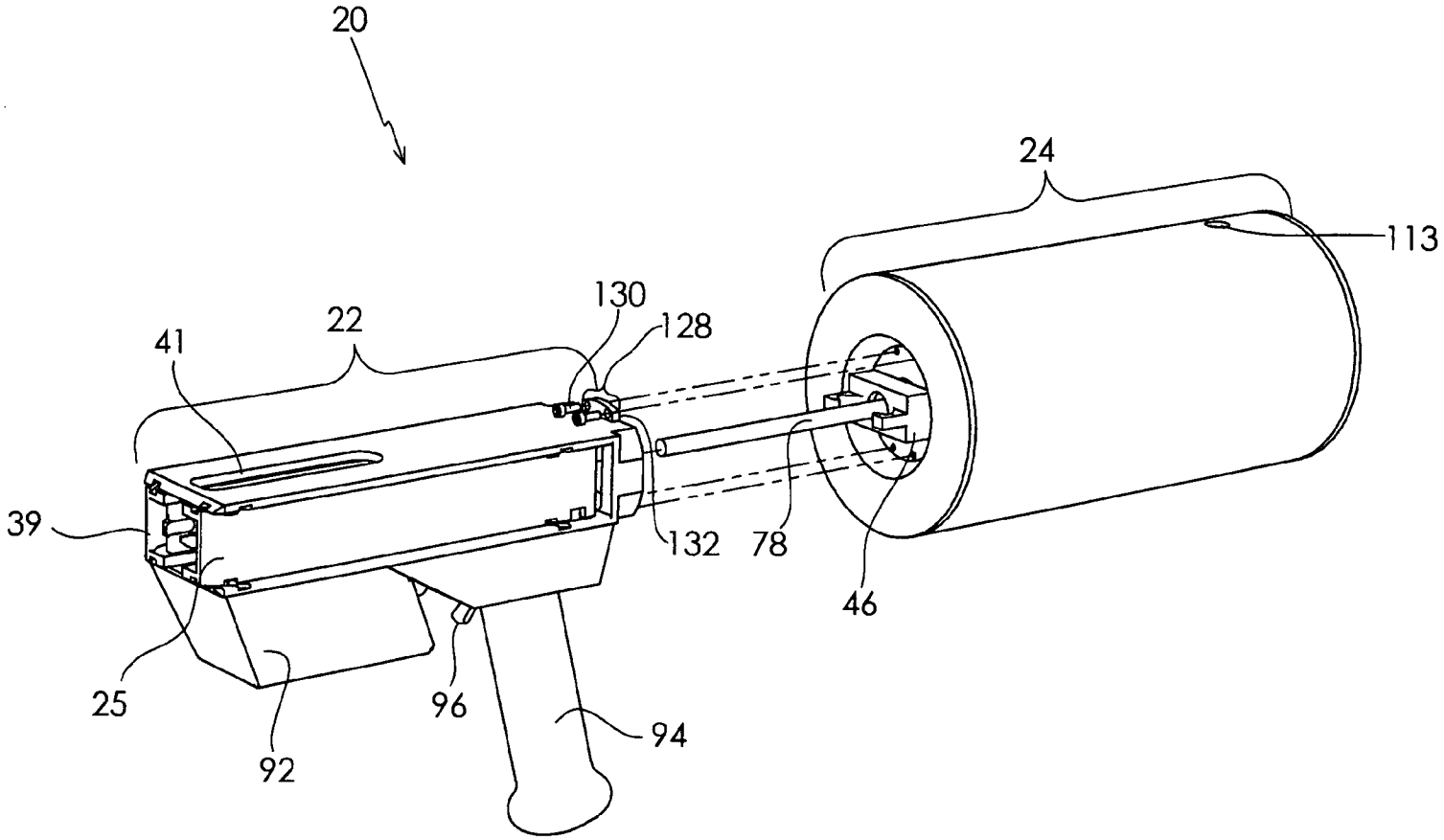
FIG. 2 is an exploded view of the embedded element pulling apparatus illustrated in FIGS. 1*a* and 1*b* showing that the motive device is separable from the grasping assembly and replaceable with other motive devices.

Embedded element pulling apparatus 20 is shown in FIGS. 1*a* and 1*b*. Embedded element pulling apparatus 20 comprises an embedded element grasping assembly 22 and a motive device 24. Grasping assembly 22 is preferably separable from the motive device as shown in FIG. 2 so that the grasping assembly can be powered by different motive devices to accommodate to different work environments. In other embodiments embedded element pulling apparatus 20 may be fabricated as an integrated device with both the grasping assembly 22 and motive device 24 permanently contained within the same housing 25. Although FIGS. 1, 2, 9, 10 and 12 show a specific type of pneumatic motive device 24, it is understood that the motive device could be any one of a wide variety of alternative motive devices that operate by using mechanical, electric, magnetic, hydraulic, pneumatic and explosive principles.

Figure 3:
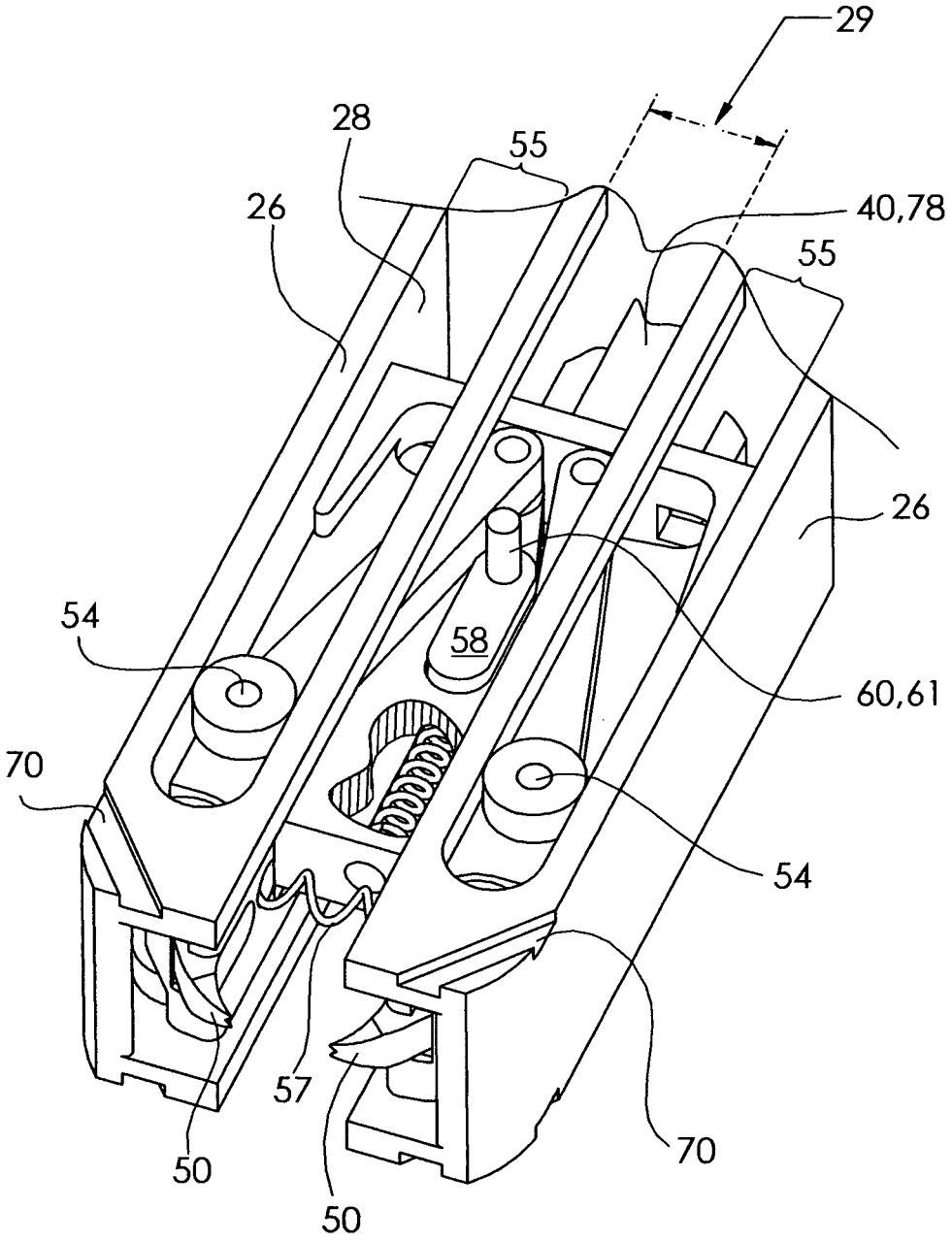
FIG. 3 is a partial cutaway, perspective view of the embedded element pulling apparatus illustrated in FIGS. 1*a* and 1*b* showing the carriage assembly integrated with linear guides, but apart from the housing of the grasping assembly.

FIG. 3 shows embedded element pulling apparatus 20 comprises a pair of linear guides 26 separated by a width 29. Each linear guide 26 has a length and an inner guide surface 28. Inner guide surface 28 is angled to form a closing ramp 30 at the grasping end 32. A jaw 34 is paired with each linear guide 26. Each jaw 34 is engaged to follow along inner guide surface 28. Lock assembly 36 is integrated to lock and unlock jaws 34 respectively at the grasping and un-grasping positions. Carriage assembly 37 includes carriage 38, jaws 34 and lock assembly 38. Carriage 38 cooperatively couples jaws 34 and lock assembly 36. Linear guides 26, carriage 38, jaws 34 and lock assembly 36 are assembled to reside within housing 25 of grasping assembly 22. Housing 25 has a grasping opening 39 and may have a viewing opening 41 for observing alignment of tooth 50 to embedded element 42 and the operation of the components within the housing. Positioning actuator 40 extending from motive device 24 engages carriage 38 to position jaws 34 along the length of linear guides 26 between the grasping and un-grasping positions prior to pulling embedded element 42. Positioning actuator 40 may be a stand-alone component such as a constant force spring, linear spring or small gas spring that repositions carriage assembly 37 proximate to grasping end 32 of grasping assembly 22. Positioning actuator 40 may also be coupled to a motive device that provides motion to the positioning actuator; this is the case when using position shaft 78 combined with motive device 24, position chamber 107 residing within shaft 80, and orifice 126 to fill the chamber. Drive actuator 44 extending from motive device 24 engages with carriage 38 via retraction element 46 to close jaws 34. Drive actuator 44 is a mechanically engaging element coupled to a motive device that provides force and motion. Drive actuator 44 may be drive shaft 80 coupled with motive device 24 as described in the present disclosure. Drive actuator 44 may also include other components such as a rotary motor, a linear motor, a pneumatic cylinder, a hydraulic cylinder or an internal combustion cylinder. When jaws 34 are securely closed onto embedded element 42, drive actuator 44 is moved away from grasping end 32 to remove the embedded element from the embedding material 45. When drive actuator 44 reaches un-grasping end 48, lock assembly 36 unlocks and releases the embedded element 42.

Figure 4:
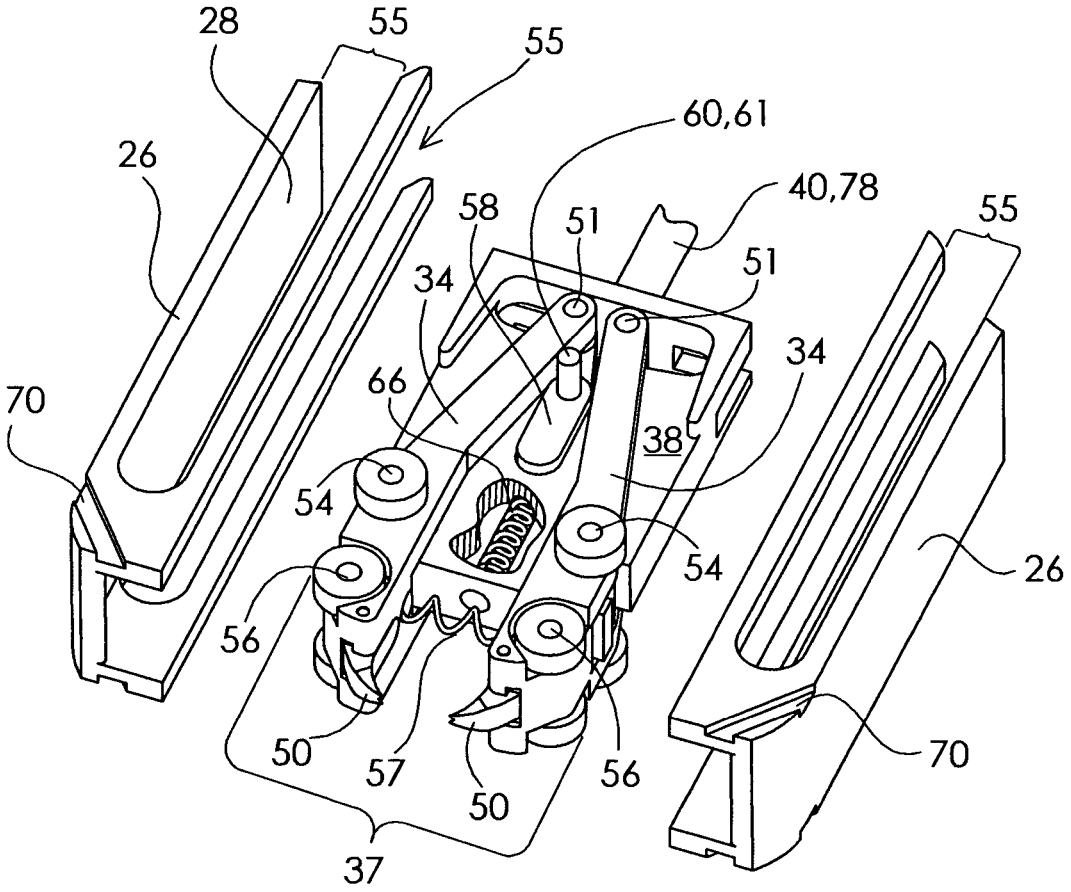
FIG. 4 is a partially-exploded and partially-cutaway, perspective view of the components of FIG. 3.

In FIG. 4, linear guides 26 have been exploded away to better show how carriage 38 couples jaws 34 and lock assembly 36. Each jaw 34 is an elongated, curved structure that is symmetrically and cooperatively closeable. The jaw grasping end 47 of each jaw 34 terminates with an interchangeable tooth 50. The jaw locking end 49 of each jaw 34 is connected by an arm pivot 51 to one of the two locking arms 52 of lock assembly 36. Proximate the midpoint along the length of each jaw 34 is a jaw pivot 54. Jaw pivot 54 of each jaw 34 engages carriage 38 along jaw pivot slot 35 and allows for the pivoting action that enables the jaw to grasp an embedded element 42 at jaw grasping end 47 and lock the jaw at jaw locking end 49. The structure of jaw pivot 54 is such as to have a radius that extends beyond the outer edge of each jaw and provides a rolling or sliding surface to engage with the inner surface 28 of the corresponding linear guide 26. Jaw pivot 54 moves along inner surface 28 and within linear guide slot 55. Each linear guide 26 may have a pair of linear guide slots 55, one on the top and one on the bottom. A grasping guide 56, located forward of the jaw pivot 54 towards tooth 50, is included on each jaw 34 to engage with closing ramp 30 to cause the grasping action of the jaw. The structure of grasping guide 56 is such as to have a radius that extends beyond the outer edge of each jaw 34 and provides a rolling or sliding surface to engage with the inner surface 28 of the corresponding linear guide 26. Grasping guide 56 also aids with the smooth closing of jaw 34 by moving against the closing ramp 30. The jaw grasping ends 47 of the pair of jaws 34 are kept separated by jaw bias 57 that pushes the jaws apart until the jaws are forced to grasp embedded element 42 when grasping guide 56 is forced against closing ramp 30.

Figure 5A:
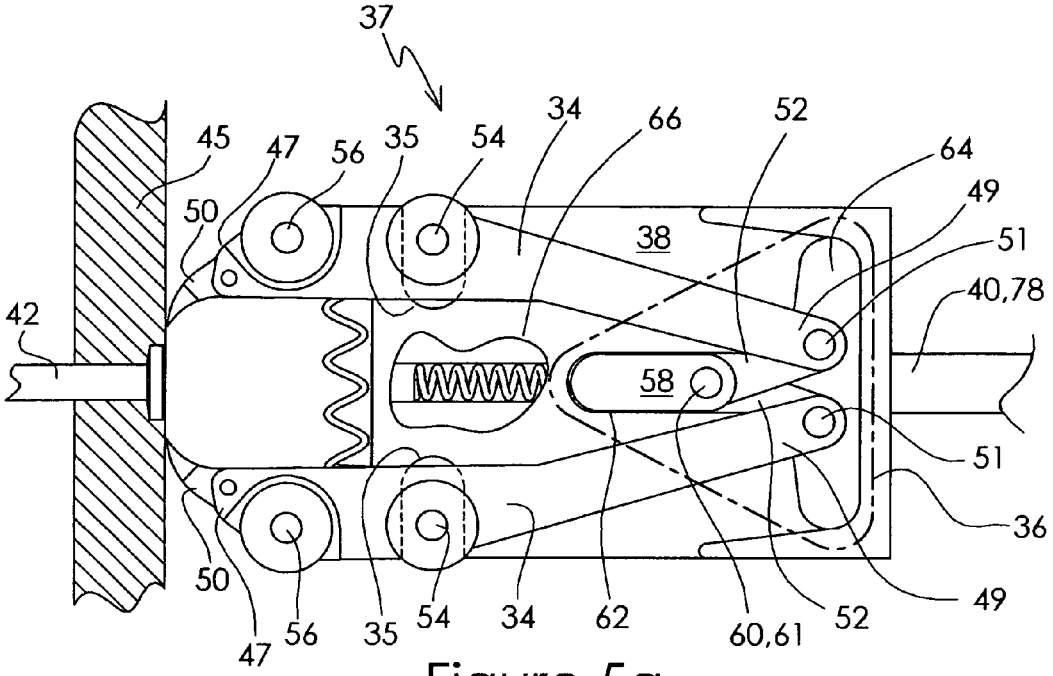
FIG. 5*a* is a top, plan view of the carriage assembly of FIG. 3 showing the locking assembly unlocked.
Figure 5B:
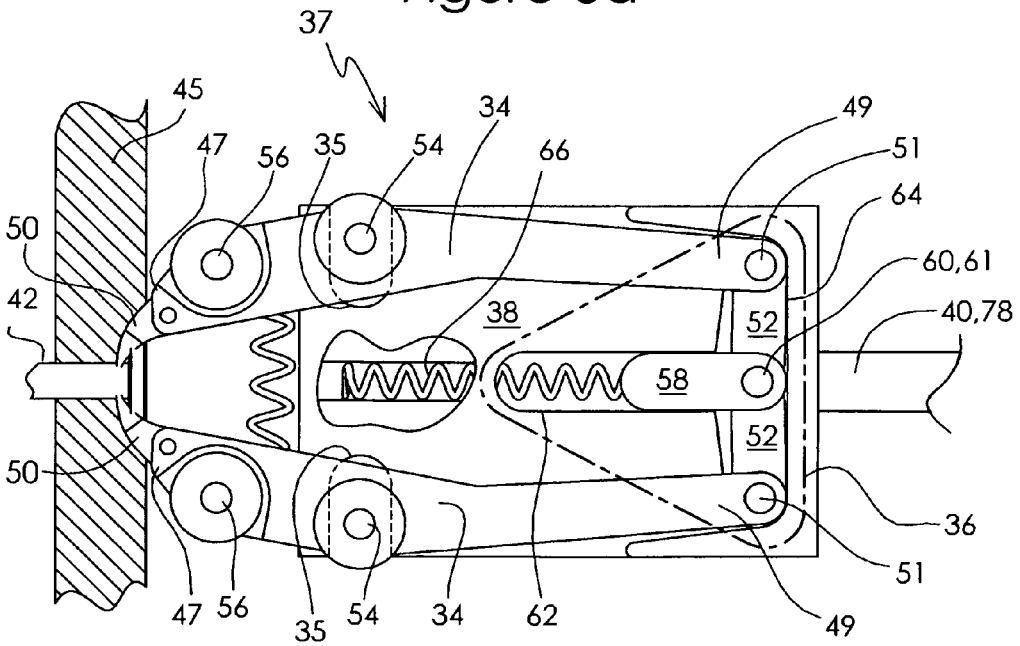
FIG. 5*b* is a top, plan view of the carriage assembly of FIG. 3 showing the locking assembly locked.

FIGS. 5*a* and 5*b* illustrate how lock assembly 36 is integrated with carriage 38 to enable locking and unlocking of jaws 34. Lock assembly 36 is configured to be an over-center lock assembly that includes a lock activation element 58 and two locking arms 52. The two locking arms 52 are connected to lock activation element 58 at their inner ends by lock pivot 60 and to jaws 34 by respective arm pivots 51 at their jaw ends. Lock pivot 60 has an extension, lock pin 61, extending from the lock pivot. Lock pivot 60 moves along lock guide slot 62 within carriage 38. Arm pivots 51 move within lock activation slot 64 that is channeled within carriage 38. Lock bias 66 provides a bias that pushes on lock activation element 58. Lock activation occurs when lock pivot 60 is pulled away from the grasping end by locking arms 52 and pushed by lock bias 66 beyond the center line. The center line being defined by the line connecting arm pivots 51. Unlocking occurs when carriage assembly 37 is pulled away from grasping end 32 and lock pin 61 hits a fixed element 67 on the inside of housing 25. Fixed element 67 pushes lock pivot 60 beyond the center line of lock activation slot 62 causing jaws 34 to open and thereby releasing embedded element. 42.

Figure 6A:
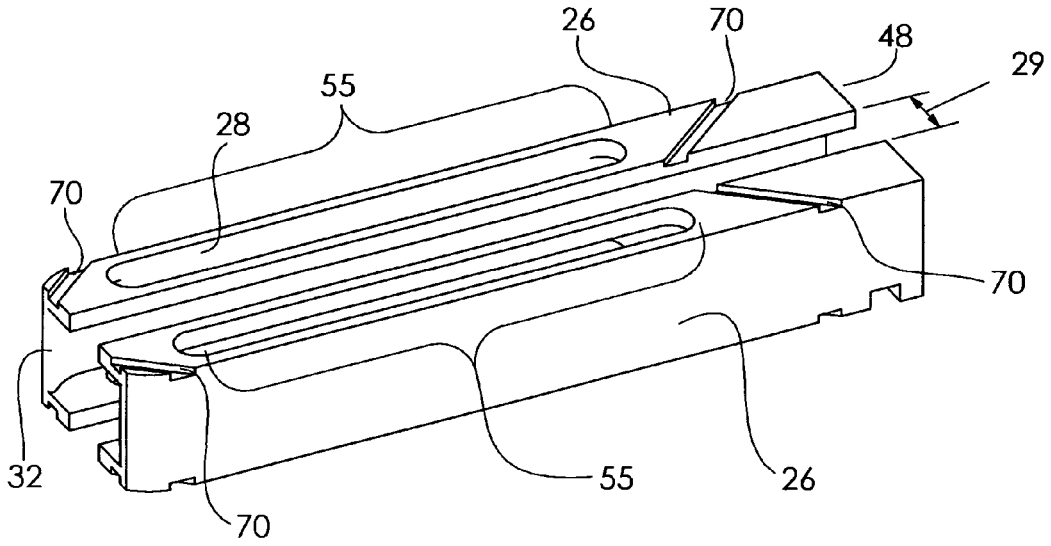
FIG. 6*a* is a perspective view of the linear guides for the embedded element pulling apparatus illustrated in FIGS. 1*a* and 1*b;*
Figure 6B:
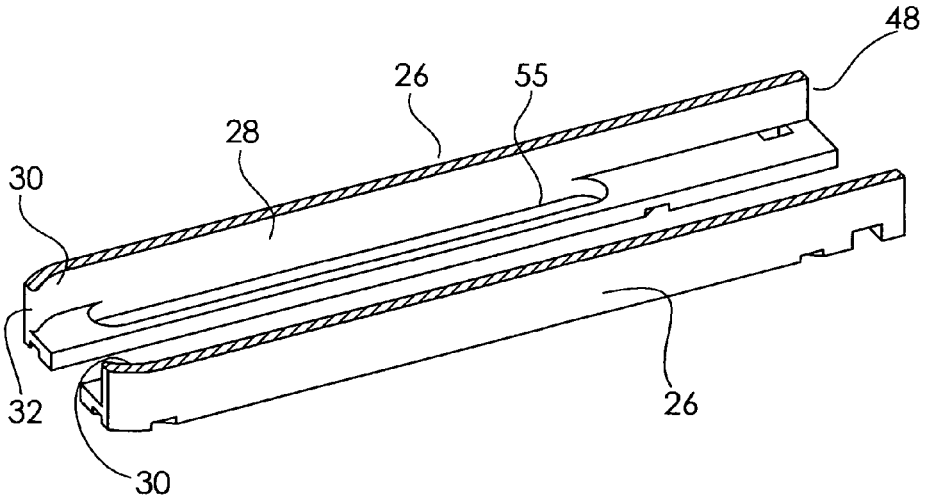
FIG. 6*b* is a partial cutaway, perspective view of the linear guides illustrated in FIG. 6*a;*
Figure 7A:
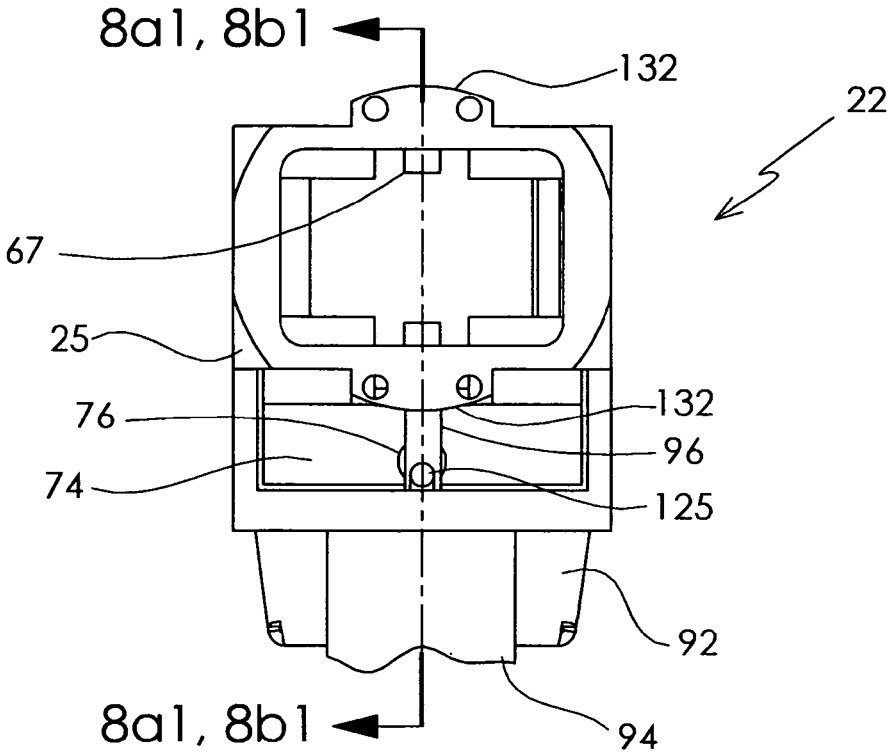
FIG. 7*a* is a back view of gasping assembly with carriage assembly hidden for the embedded element pulling apparatus of FIGS. 1*a* and 1*b;*
Figure 7B:
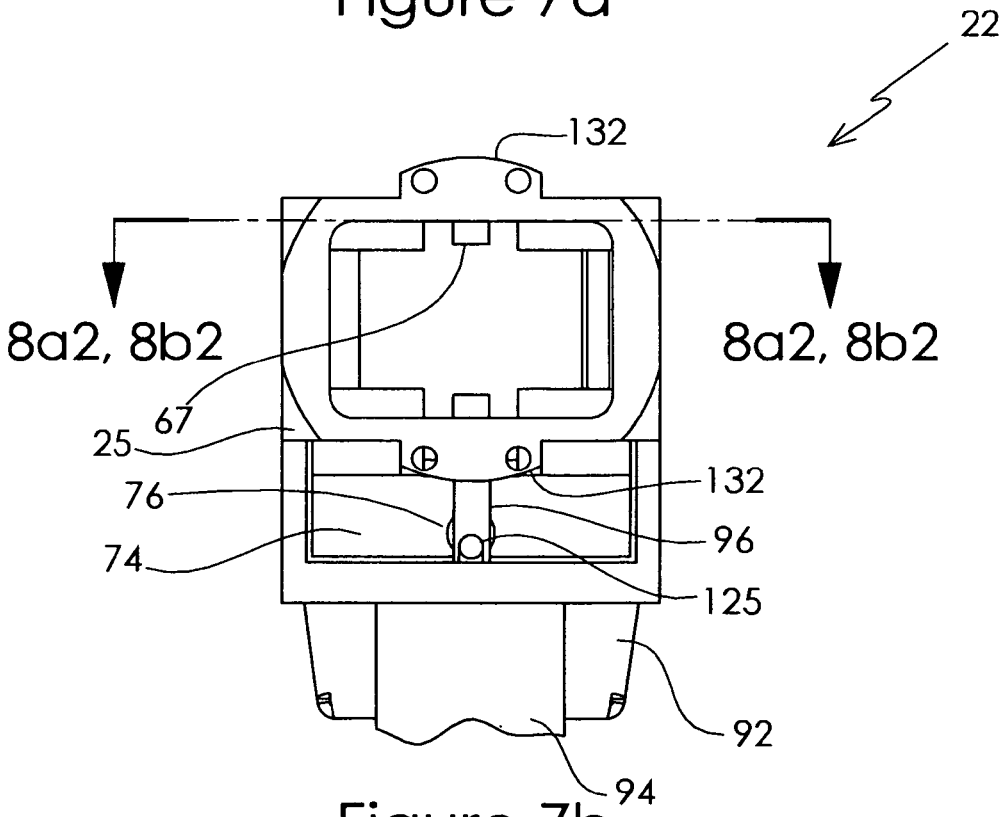
FIG. 7*b* is a back view of grasping assembly with carriage assembly hidden for the embedded element pulling apparatus of FIGS. 1*a* and 1*b;*

Linear guides 26 are shown in FIGS. 6*a* and 6*b*. Linear guides 26 are two parallel and symmetric linear guides forming a pair of linear guides. Each linear guide 26 has a length and an inner guide surface 28. Inner guide surface 28 is angled to form a closing ramp 30 at the grasping end 32. Having the closing ramp 30 of each linear guide 26 turn inward towards the middle of grasping assembly 22 provides the necessary structure for closing jaws 34 onto an embedded element 42. Each linear guide 26 further includes a linear guide slot 51 for guiding jaw pivot 54. Linear guides 26 are separated by a width 28. The width between linear guides 26 may be adjusted to accommodate the pulling of different sized embedded elements 42 and the amount of grasping force imparted to teeth 50 for holding onto the shank of the embedded element 42.

Width adjustment occurs via the use of a width adjustment assembly 68 shown in FIGS. 7*a-b* and 8*a*1-8*b*2. With adjustment assembly 68 is incorporated as part of embedded element pulling apparatus 20 in grasping assembly 22. Width adjustment assembly 68 includes at least one pair of diagonal guide elements 70, one element associated with each linear guide 26. It is preferably to have two diagonal guide elements 70 in each linear guide 26, one diagonal guide element near the grasping end and one diagonal guide element near the locking end of each linear guide. Two diagonal guide elements 70 provide for smoother adjustment. Diagonal guide elements 70 include a fixed guide and a mobile element 72 that is constrained by and moves relative to the fixed guide element. Examples of fixed guides are a slot, groove or channel. Examples of mobile elements 72 are a key, a key and spring, balls, a linear bearing or rollers. Diagonal guide elements 70 constrain linear guide 26 to move along the length of the diagonal guide element. This structure keeps the linear guides 26 parallel while being able to change width 28. Closing fork 74 in cooperation with positioner 76 allows the user to change the width between linear guides 26. Each side of closing fork 74 is connected to one of the linear guides. Positioner 76 translates linear guides 26 along the length of housing 25, which in turn causes the linear guides to widen or narrow as they follow translatable guide elements 70. Positioner 76 may be threaded or have a cam to move the positioner relative to housing 25.

Movement of carriage assembly 37 within grasping assembly 22 and along linear guides 26 is governed by one of two actuators, either by positioning actuator 40 or drive actuator 44. Positioning actuator 40 may include a positioning shaft 78 and possibly other components to enable the positioning actuator to set the position of carriage assembly 37. Drive actuator 44 includes a drive shaft 80 in cooperation with retraction element 46 and possibly other components to provide a drive force to the carriage assembly 37. Drive actuator 44 is able to move independently of carriage 38. In a preferred embodiment, positioning actuator 40 is concentric to and resides within drive actuator 44. However in other embodiments, positioning actuator 40 may reside parallel to the drive actuator 44, but not necessarily concentric to the drive actuator. Positioning actuator 40 is used to move carriage assembly 37 from the un-grasping end 48 to grasping end 32 of grasping assembly 22 so that the carriage assembly can be in a ready position with jaws 34 open and ready to be driven against closing ramp 30. Drive actuator 44 is used to drive jaws 34 against closing ramp 30, close the jaws and active lock assembly 36. Drive actuator 44 further includes a retraction element 46. Retraction element 46 is for engaging with carriage assembly 37 so that the carriage assembly can be pulled along linear guides 26 away from grasping end 32. Retraction element 46 has two retraction arms 86 with corresponding retraction gaps 88. When lock assembly 36 is in the locked state the jaw ends of locking arms 52 fit securely within retraction gaps 88 allowing carriage assembly 37 to be pulled away from grasping end 32.

Several other elements are incorporated as part of grasping assembly 22. Grasping assembly 22 includes a disposal slot 90 within housing 25 for disposal of pulled embedded elements 42. An optional embedded element receptacle 92 may be attached to housing 25 to collect removed embedded elements. Disposal slot 90 is aligned with embedded element receptacle 92. Integrated with housing 25 is a handle 94 for ergonomic holding of embedded element pulling apparatus 20. A trigger 96 is also integrated with handle 94. Pressing trigger 96 initiates closure of jaws 34 onto embedded element 42 after the user has aligned embedded element pulling apparatus 20 to the embedded element. Releasing trigger 96 initiates the jaws to pull embedded element 42 and bring the embedded element to receptacle 92 for collection and disposal.

Figure 9:
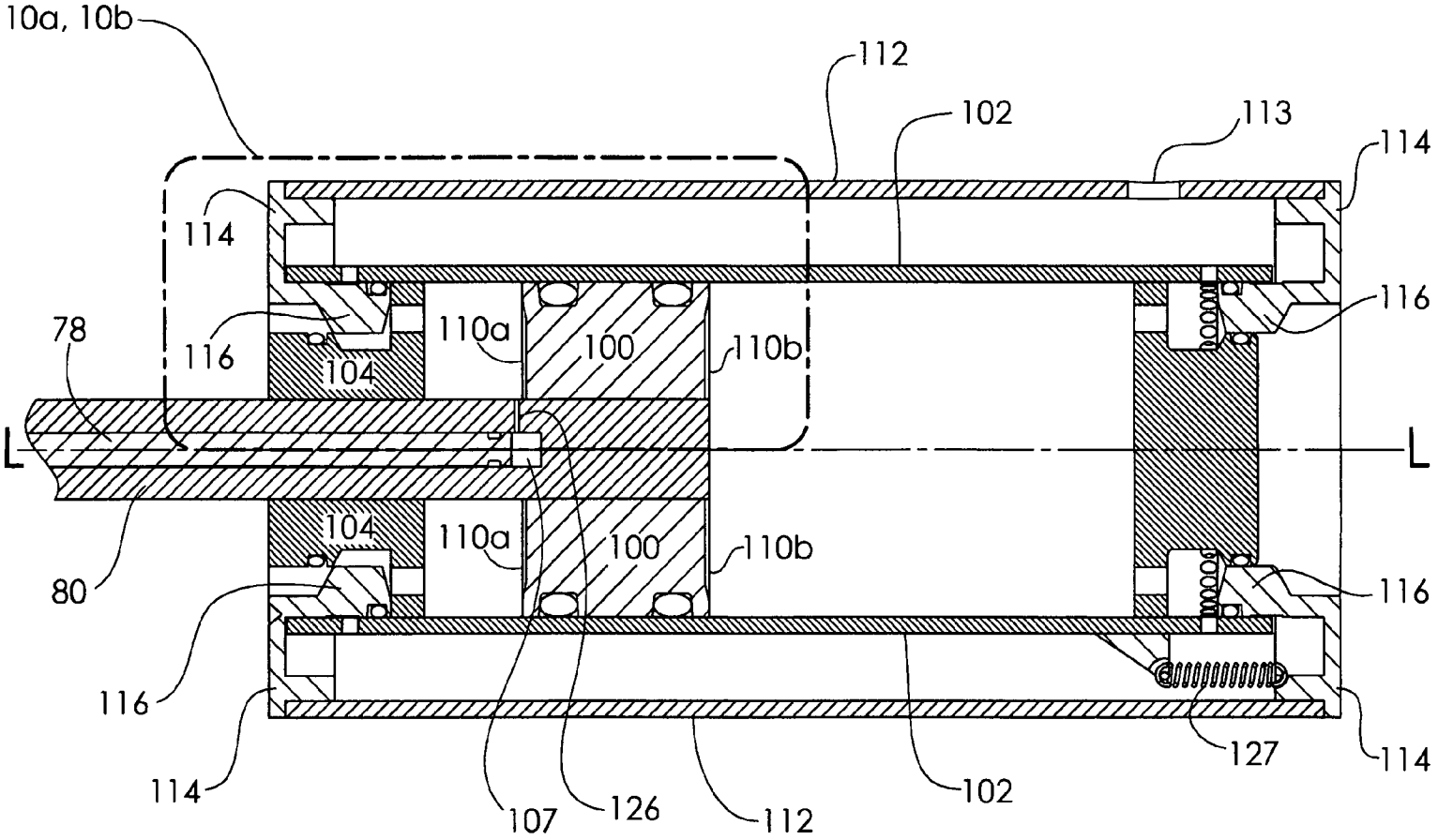
FIG. 9 is a side, sectional view of one embodiment of the motive device of the embedded element pulling apparatus illustrated in FIGS. 1*a* and 1*b;*

Various types of motive device 24 can be connected to grasping assembly 22 to support movement of positioning actuator 40 and drive actuator 44. FIG. 9 show a specific motive device 24 that uses pneumatic or hydraulic principles. The uniqueness of motive device 24 is that the motive device can provide a high rate of fluid delivery and exhaust to the chambers on either side of piston 100 and thereby create fast actuation with high impact force for drive actuator 44. Motive device 24 comprises a tube 102. Tube 102 has a tube wall, a tube interior, a tube exterior, opposite tube ends and a longitudinal axis L. Tube end caps 104 are fitted proximate each tube end. Tube end caps reside a short distance inside from the ends of tube 102. Each tube end cap has a large radius section 105 and a small radius section 106. Each large radius section 105 is mounted to the interior wall of tube 102 with small radius section 106 extending outward from the center of the tube. Each small radius section 106 forms a valve gap 108 between the inside wall of tube 102 and each small radius section. The interior tube volume is bounded by the interior tube wall surface and interior surfaces of both tube end caps 104. A piston 100 is positioned in the interior tube volume and movable along longitudinal axis L. Piston 100 is movable along between both tube end caps 104. Piston 100 has a first piston side 110*a* and a second piston side 110*b*. A pressure reservoir 112 surrounds the exterior of tube 102. Pressure reservoir 112 has a pressure source inlet 113 from an external pressure source. Pressure reservoir 112 has two reservoir end caps 114, each reservoir end cap is paired with a valve gap 108. Each reservoir end cap has a valve element 116 fitting within each valve gap 108. Trigger 96 connects with motive device 24 so that the trigger facilitates the movement of pressure reservoir 112 along longitudinal axis L relative to tube 102. The alternating movement of reservoir 112 relative to tube 102 allows fluid to pressurize one side of piston 100 while venting the other side of the piston thereby causing the piston to move between the two ends of tube 102.

Figure 10A:
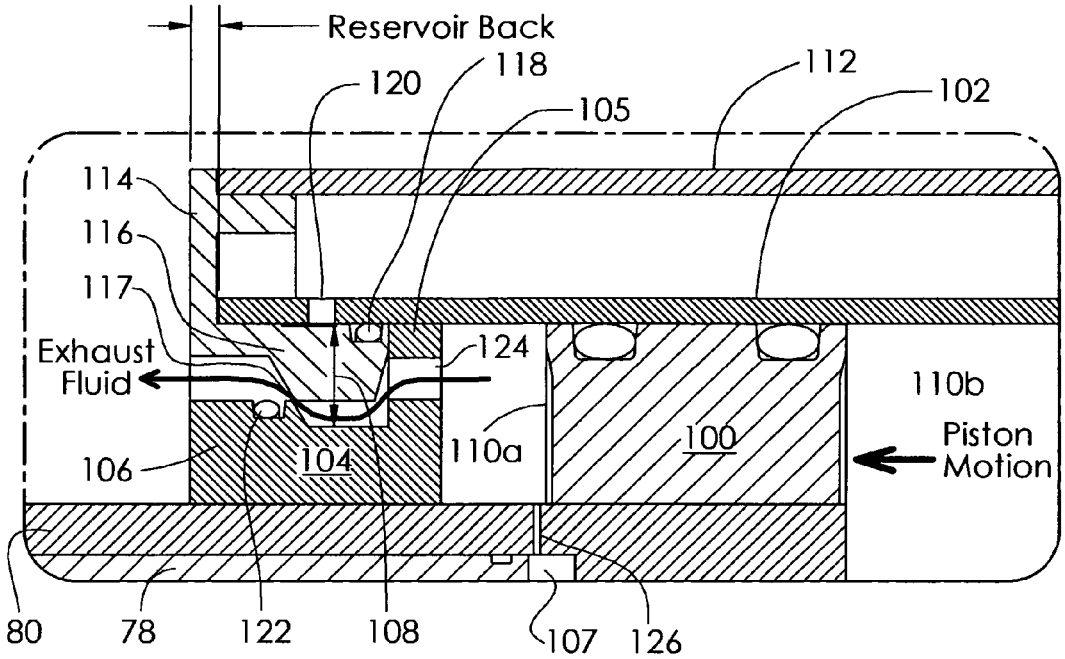
FIG. 10*a* is an enlarged view of the dashed outline in FIG. 9 with the valve configuration in the exhausting state.
Figure 10B:
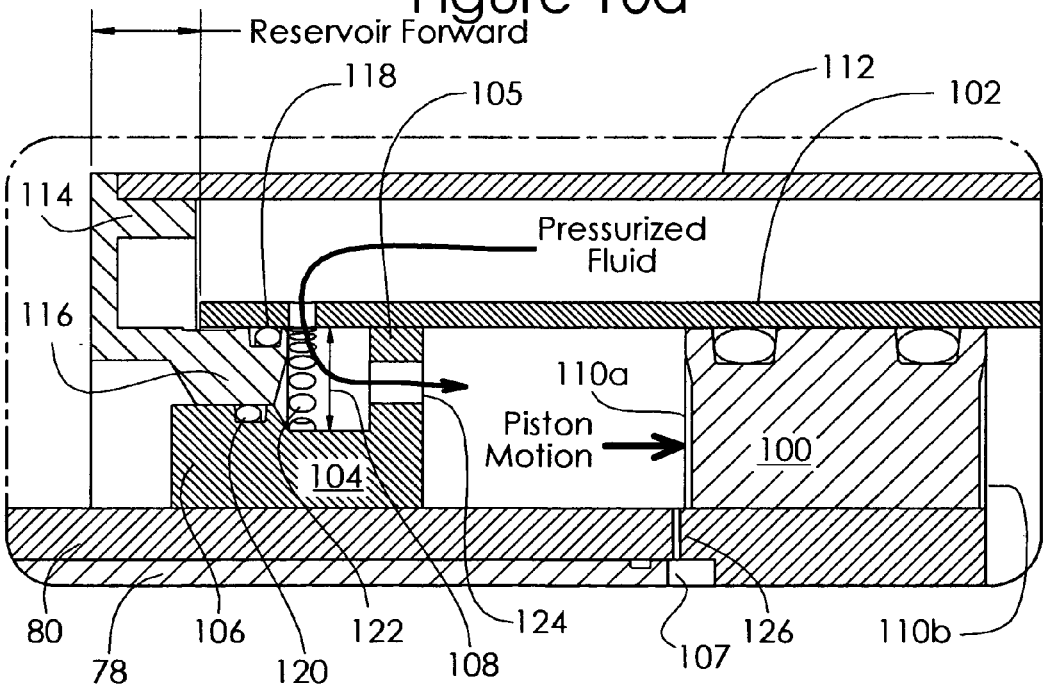
FIG. 10*b* is an enlarged view of the dashed outline in FIG. 9 with the valve configuration in the pressurizing state.
Figure 11A:
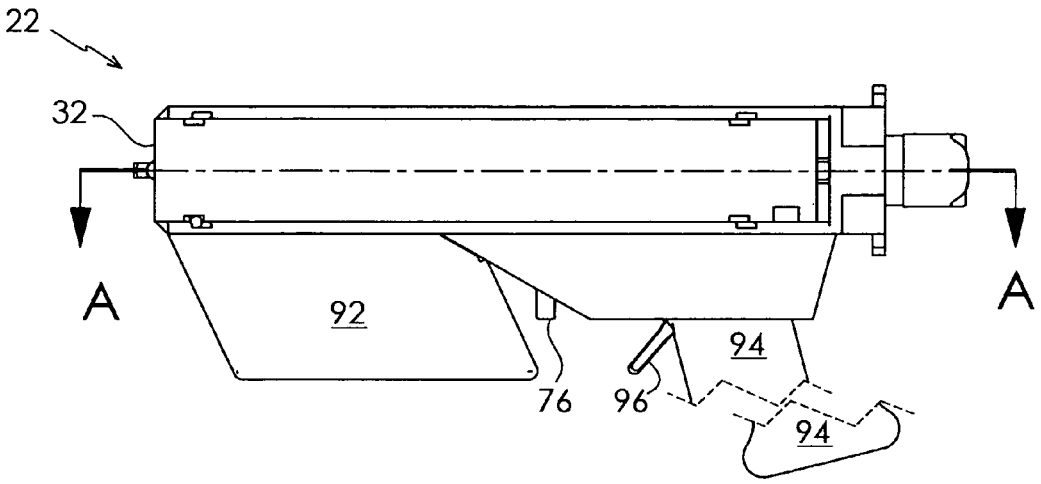
FIG. 11*a* is a side view of the grasping assembly of the embedded element pulling apparatus of FIGS. 1*a* and 1*b* indicating the section views used in FIGS. 11*b-f;*
Figure 11B:
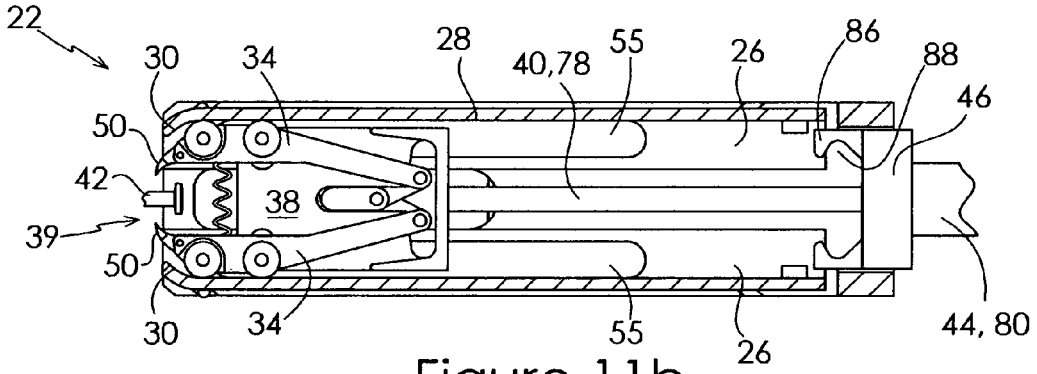
FIG. 11*b* is a top sectional view of the grasping assembly of FIG. 11*a* along line A-A indicating a first step in grasping and removing an embedded element.
Figure 11C:
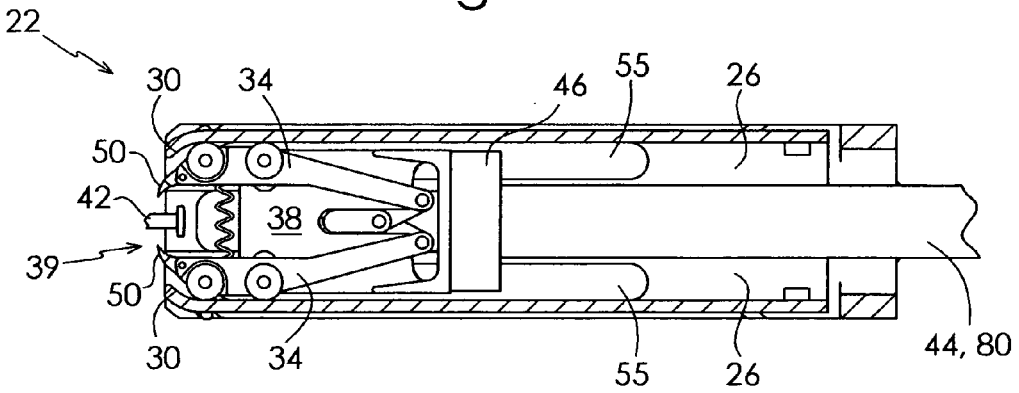
FIG. 11*c* is a top sectional view of the grasping assembly of FIG. 11*a* along line A-A indicating a second step in grasping and removing an embedded element.
Figure 12A:
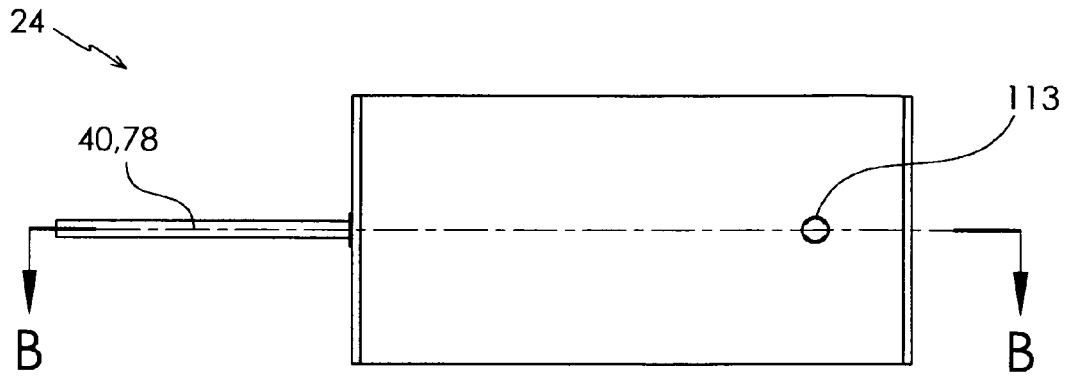
FIG. 12*a* is a side view of the motive device of the embedded element pulling apparatus of FIG. 1 indicating the section views used in FIGS. 12*b-f;*
Figure 12B:
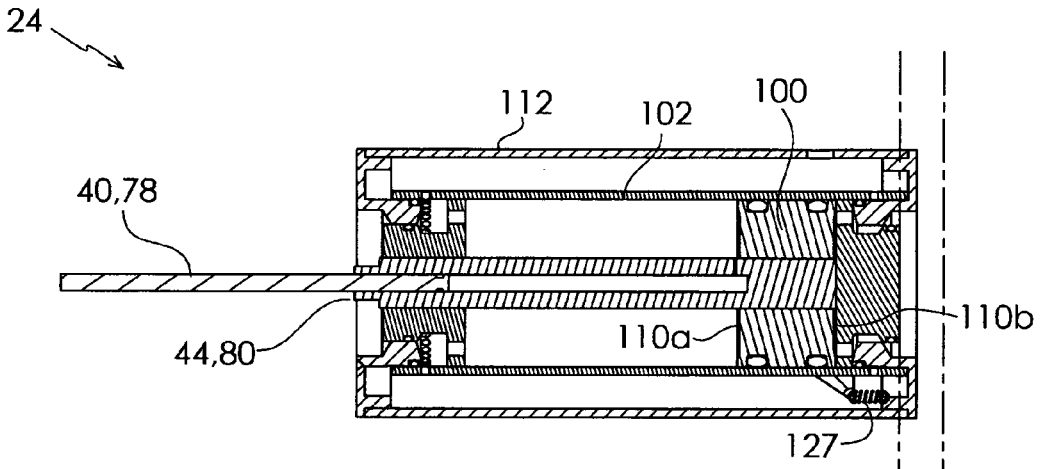
FIG. 12*b* is a top sectional view of the motive device of FIG. 12*a* along line B-B corresponding with the first step of the grasping assembly shown in FIG. 11*b;*
Figure 12C:
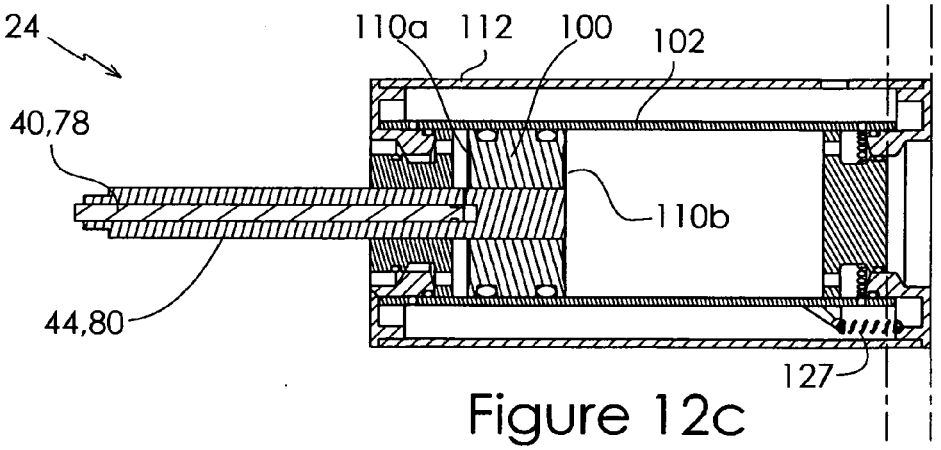
FIG. 12*c* is a top sectional view of the motive device of FIG. 12*a* along line B-B corresponding with the second step of the grasping assembly shown in FIG. 11*c;*
Figure 12D:
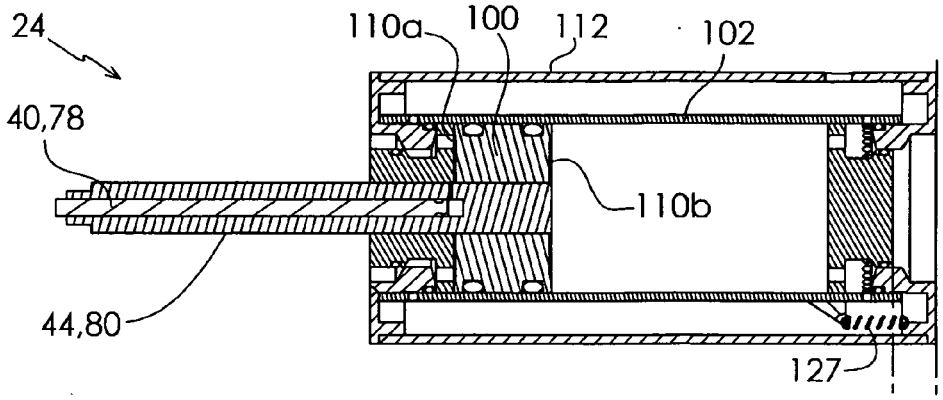
FIG. 12*d* is a top sectional view of the motive device of FIG. 12*a* along line B-B corresponding with the third step of the grasping assembly shown in FIG. 11*d;*
Figure 12E:
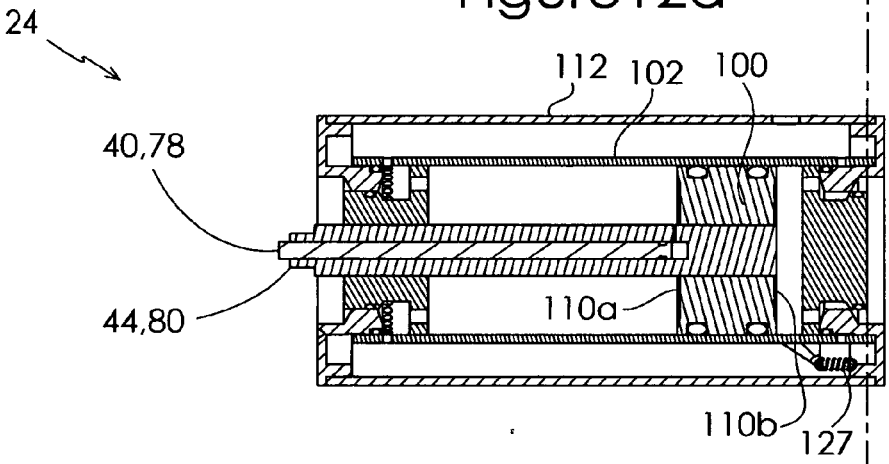
FIG. 12*e* is a top sectional view of the motive device of FIG. 12*a* along line B-B corresponding with the fourth step of the grasping assembly shown in FIG. 11*e;*
Figure 12F:
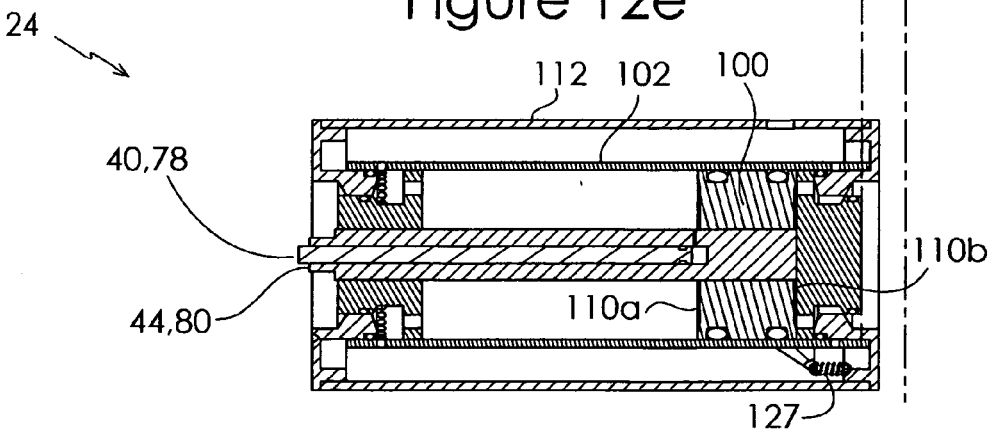
FIG. 12*f* is a top sectional view of the motive device of FIG. 12*a* along line B-B corresponding with the fifth step of the grasping assembly shown in FIG. 11*f;*

FIGS. 10*a* and 10*b* detail the valve structures for motive device 24 and how the valves work. Note that the valve structures themselves are symmetric relative to both ends of motive device 24. Movement of pressure reservoir 112 relative to tube 102, initiated by trigger 96, is what changes the state of each valve at the two ends of motive device 24. Each valve element 116 has a pressure seal 118 around the interior of tube wall 102 for sealing between the interior wall of tube 102 and the valve element. Tube 102 has at least one tube opening 120. It is preferable to have a plurality of tube openings 120 around the circumference of the tube that lead from reservoir 112 into valve gap 108. The more tube opening area, the faster tube 102 can be pressurized. An exhaust seal 122 around small radius section 106 provides for sealing between valve element 116 and tube end cap 104. Each tube end cap 104 has at least one end cap opening 124. It is preferable to have a plurality of end cap openings 124 through large radius section 105. The more end cap opening area, the faster tube 102 can be pressurized and exhausted. In the exhausting state for first piston side 110*a*, FIG. 10*a*, valve element 116 is moved all the way into valve gap 108 and touches large radius section 105 of tube end cap 104. The fluid that is interior tube 102 and adjacent to first piston side 110*a* is exhausted through end cap openings 124 into valve gap 108 and around valve element 116 via exhaust gap 117. During this state, pressure seal 118 stops fluid in pressure reservoir 112 from escaping and allows pressure to build within the pressure reservoir. In the pressurizing state for first piston side 110*a*, FIG. 10*b*, valve element 116 is moved away from large radius section 105 of tube end cap 104. A new seal is created between valve element 116 and exhaust seal 122. Pressure seal 118 then moves past the tube openings 120 and allows fluid to flow from pressure reservoir 112 through tube openings 120 into valve gap 108 and into the interior of tube 102 through end cap openings 124. The valve states are opposite (pressuring or exhausting) for each end of motive device 24. When the valve on one end is open the valve on the other end is closed. The novel structure of a plurality of tube openings 120 and plurality of end cap openings 124 allows fluid to be transferred from pressure reservoir 112 very quickly. This novel structure also allows fluid to be exhausted from inside tube 102 very quickly.

The embedded element pulling apparatus 20 described requires a large amount of energy/momentum to be imparted to drive actuator 44 so that jaws 34 will be able to embed into embedded material 45, grab around the shank of embedded element 42 and pull the embedded element out of the embedded material. For this reason the motive element 24 shown in FIGS. 1, 2, 9, 10 and 12 is a preferred embodiment for the motive element. The plurality of tube openings 120 and end cap openings 124 can provide 20 to 30 times the area of a pressurized hose. When this large pressure area is combined with the proximity of a local pressure reservoir 112, quick pressure delivery and quick exhaust can be provided to drive actuator 44. This allows for a high momentum apparatus to be attained. Embedded element pulling apparatus 20 can attain a cycle of grasping and removing embedded element 42 in less than one second and preferably less than one tenth of a second.

Piston 100 may drive a variety of configurations of actuation elements. Piston 100 may have a single shaft existing one end of tube 102. Piston 100 could have two shafts, one exiting both ends of tube 102. Piston 100 may also have two shafts exiting one end of tube 102. This configuration is the preferred embodiment for providing actuation to grasping end 22 of embedded element pulling apparatus 20. In this configuration position shaft 78 is concentric with drive shaft 80 and moves within the drive shaft. At the end of drive shaft 80 that resides within the interior cavity of tube 102 is a small orifice 126. When drive shaft 80 is pulled back within the interior of tube 102, orifice 126 provides a pathway for pressurized fluid to reach the back end of positioning shaft 78 filling position chamber 107. The fluid extends positioning shaft 78 out of drive shaft 80. This action is useful in positioning carriage assembly 37 into a ready state near grasping end 32.

FIGS. 8*a*1, 8*b*1 and 9 show one embodiment for trigger 96 and how the trigger may be integrated as part of embedded element pulling apparatus 20 to activate motive device 24. A rod 125 connects trigger 96 to the housing of pressure reservoir 112. When trigger 96 is pulled, rod 125 pushes pressure reservoir away from grasping assembly 22. When trigger 96 is released, a trigger bias element 127 in the motive element (the trigger bias element could be located in housing assembly as well), returns pressure reservoir 96 to the forward position closer to grasping assembly 22. When trigger 96 is pulled, motive element 24 that powers drive actuator 44 is energized. This causes the forward motion of carriage assembly 37 and drives teeth 50 to grasp embedded element 42. When trigger 96 is released, the reverse motion of drive actuator 44 is energized. This causes embedded element 42 to be pulled backwards and released. Several alternative implementations of trigger 96 are possible. These alternatives may include using a pneumatic or hydraulic valve, actuated by trigger 96, which in turn activates a small pneumatic or hydraulic actuator to push and pull on the housing of pressure reservoir housing 112. In another alternative implementation, drive actuator 44 maybe coupled with an electrical or magnetic motive device, trigger 96 would activate an electrical switch to energize the motion. Similarly, such an electrical switch could activate an internal combustion or explosive motive device.

As shown in FIG. 2, grasping assembly is connected to motive device via a fastener assembly 128. The specific fastener assembly 128 in FIG. 2 is four screws 130 securing two arms 132 mounted to grasping assembly 22 that are attached to the front face of motive device 24. However, it is understood that fastener assembly 128 could take the form of various structures that include one or more fasteners from the group including screws, a twist lock, a snap ring and pins.

The operation of embedded element pulling apparatus 20 is shown in two corresponding series of figures. FIGS. 11*a*-11*f* illustrate the workings of grasping assembly 22 and FIGS. 12*a*-12*f* illustrate the corresponding workings of motive device 24. In the ready position, FIGS. 11*b* and 12*b*, the teeth 50 proximate grasping opening 39 of embedded element pulling apparatus 20 are aligned to either side of embedded element 42. In this position, carriage assembly 37 is forward and located at the base of closing ramps 30. Jaws 34 are open. Lock assembly 36 is unlocked. Drive shaft 80 is retracted back into motive device 24. The user then pulls trigger 96. Pulling trigger 96 facilitates the movement of pressure reservoir 112 in a direction away from grasping assembly 22. This action cause first piston side 110*a* to be exhausted and second piston side 110*b* to be pressurized. Piston 100 moves drive shaft 80 with attached retraction element 46 to engage carriage 38, FIGS. 11*c* and 12*c*. Piston 100 continues pushing drive shaft 80, which moves carriage assembly 37 forward up closing ramps 30, FIGS. 11*d* and 12*d*. As jaws 34 are closed, the jaws grasp onto the shank of one embedded element 42 to engage opposite sides of the embedded element. Locking arms 52 are pushed beyond the center line so that the jaw ends of locking arms 52 fit securely within retraction gaps 88. The user then releases trigger 96. Releasing trigger 96 facilitates the movement of pressure reservoir 112 in a direction towards grasping assembly 22. This causes first piston side 110*a* to be pressurized and second piston side 110*b* to be exhausted. Piston 100 moves drive shaft 80 with carriage assembly 37 securely attached to be pulled away from grasping end 32 until lock pin 61 of the carriage assembly reaches fixed element 67 on the inside of housing 25, FIGS. 11*e* and 12*e*. Carriage assembly 37 continues to move towards motive device 24 causing fixed element to move lock pin 61 back over the centerline and release embedded element 42. Embedded element 42 then drops through disposal slot 90 and into receptacle 92. Fluid slowly bleeds through orifice 126 to move positioning shaft 78 with carriage assembly 37 to the ready position.

Different types of interchangeable grasping teeth 50 may be incorporated with embedded element pulling apparatus 20 depending on the type of embedded element 42 to be removed and the precision with which the embedded element must be removed. FIGS. 13*a*-*j* illustrate how teeth 50 are attached to jaw 34 and the different types of teeth that can be used depending on the job at hand. Each grasping tooth 50 has a tooth width, a tooth grasping end and a generally arched shape that thins towards the tooth grasping end. Each tooth 50 has a tooth guide 134 that extends beyond the width of the tooth and slideably fits within a tooth slot 136 in each jaw. Each tooth is held in place by a tooth fastener 138. Tooth fastener 138 may pass within a tooth fastener opening 140 in both jaw 34 and tooth 50. Some teeth 50 may include a shank notch 142 at the grasping end.

Figure 13A:
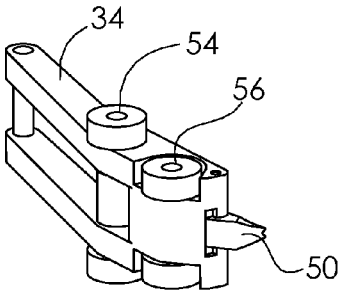
FIG. 13*a* is a perspective view of the jaw of the embedded element pulling apparatus of FIGS. 1*a* and 1*b;*
Figure 13B:
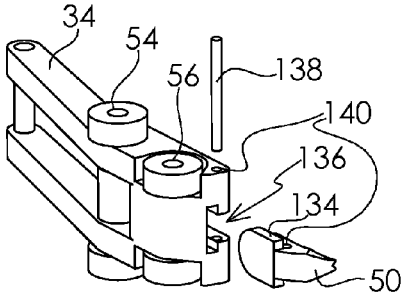
FIG. 13*b* is an exploded view of the jaw in FIG. 13*a* showing how the interchangeable tooth is attached to the jaw.
Figure 13C:
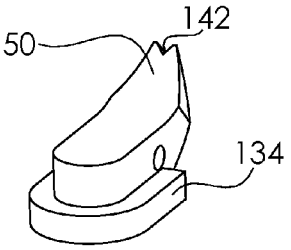
FIG. 13*c* is a perspective view of one embodiment of an interchangeable tooth that may be used in the embedded element pulling apparatus of FIGS. 1*a* and 1*b;*
Figure 13D:
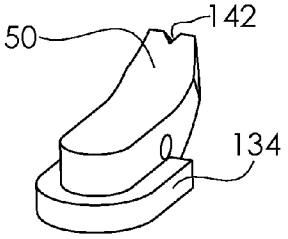
FIG. 13*d* is a perspective view of another embodiment of an interchangeable tooth that may be used in the embedded element pulling apparatus of FIGS. 1*a* and 1*b;*
Figure 13E:
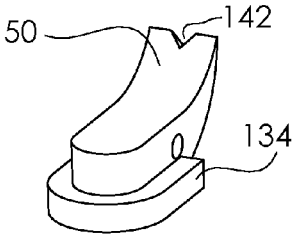
FIG. 13*e* is a perspective view of yet another embodiment of an interchangeable tooth that may be used in the embedded element pulling apparatus of FIGS. 1*a* and 1*b;*
Figure 13F:
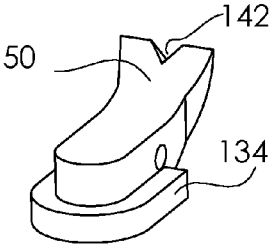
FIG. 13*f* is a perspective view of yet another embodiment of an interchangeable tooth that may be used in the embedded element pulling apparatus of FIGS. 1*a* and 1*b;*
Figure 13G:
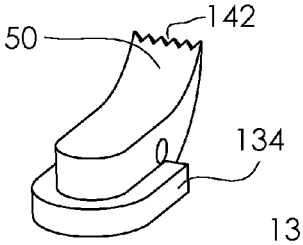
FIG. 13*g* is a perspective view of yet another embodiment of an interchangeable tooth that may be used in the embedded element pulling apparatus of FIGS. 1*a* and 1*b;*
Figure 13H:
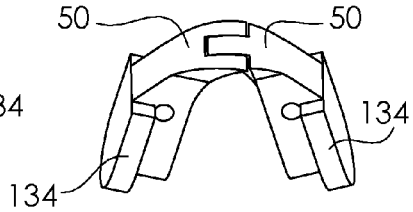
FIG. 13*h* is a perspective view of another embodiment of a combined set of interchangeable teeth that may be used in the embedded element pulling apparatus of FIGS. 1*a* and 1*b;*
Figure 13I:
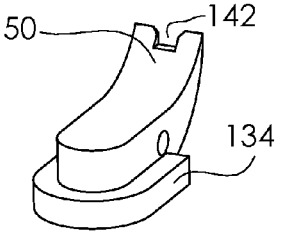
FIG. 13*i* is a perspective view of yet another embodiment of an interchangeable tooth that may be used in the embedded element pulling apparatus of FIGS. 1*a* and 1*b*.
Figure 13J:
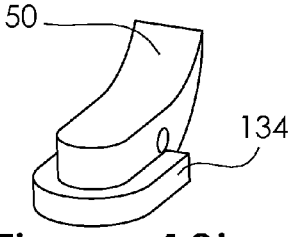
FIG. 13*j* is a perspective view of yet another embodiment of an interchangeable tooth that may be used in the embedded element pulling apparatus of FIGS. 1*a* and 1*b*.

More precision during removal of embedded elements 42 generally equates to less damage to the embedding material 45 during the removal process by localizing damage from the grasping teeth 50 to only a short distance on either side of the embedded element. More precision, however, requires tighter tolerances and more accurate positioning of the embedded element pulling apparatus 20 when aligning teeth 50 to embedded element 42. In some situations, the user may not care about damage to embedding material 45 and therefore use wider teeth 50, in favor of narrower more precise teeth, in order to more quickly complete the job. However, in other situations the user may care about damage to the embedding material 45 and therefore use narrower, more precise teeth and relinquish the speed at which the job can be completed in favor of improving the quality of the embedding material after the job is complete. FIGS. 13*c*-*e* illustrate a series of four teeth 50, the teeth are shown from most precise FIG. 13*c* to the least precise FIG. 13*f*. Other examples of teeth 50 are a general purpose tooth FIG. 13*g*. A pair of teeth for removing staples FIG. 13*h*. A tooth for removing square nails FIG. 13*i* and a cutter tooth in FIG. 13*j*.

While several embodiments of the invention, together with modifications thereof, have been described in detail herein and illustrated in the accompanying drawings, it will be evident that various further modifications are possible without departing from the scope of the invention. Nothing in the above specification is intended to limit the invention more narrowly than the appended claims. The examples given are intended only to be illustrative rather than exclusive.

What is claimed is:

1. An embedded element pulling apparatus having a grasping end, comprising:

a) a pair of linear guides separated by a width, each linear guide having a length and an inner guide surface, said inner guide surface angled to form a closing ramp at the grasping end;

b) a jaw paired with each linear guide, each jaw engaged to follow along said inner guide surface;

c) a lock assembly integrated to lock and unlock said jaws;

d) a carriage cooperatively coupling said jaws and said lock assembly;

e) a positioning actuator engaged with said carriage, said positioning actuator for moving said carriage along the length of said linear guides; and f) a drive actuator able to move independently of said positioning actuator; said drive actuator for engaging with said carriage to close said jaws, pull said embedded element, and open said jaws.

2. An apparatus as recited in claim 1, wherein said carriage includes a lock activation slot.

3. An apparatus as recited in claim 1, wherein each jaw includes a jaw pivot that pivotably couples each said jaw to said carriage.

4. An apparatus as recited in claim 1, wherein each jaw includes a grasping guide engaged to follow along said inner guide surface.

5. An apparatus as recited in claim 1, wherein each jaw includes an interchangeable grasping tooth.

6. An apparatus as recited in claim 1, wherein said positioning actuator is concentric to and moves interior said drive actuator.

7. An apparatus as recited in claim 1, wherein said positioning actuator includes a positioning shaft.

8. An apparatus as recited in claim 1, wherein said drive actuator includes a drive shaft.

9. An apparatus as recited in claim 8, wherein said drive shaft includes a retraction coupling element to engage with said carriage.

10. An apparatus as recited in claim 1, wherein said lock assembly is an over center lock assembly that includes a lock activation element and two locking arms.

11. An apparatus as recited in claim 1, wherein said pair of linear guides is two parallel linear guides.

12. An apparatus as recited in claim 1, further comprising a width adjustment assembly for adjusting the width between said pair of linear guides.

13. An apparatus as recited in claim 12, wherein said width adjustment assembly includes diagonal guide elements.

14. An apparatus as recited in claim 12, wherein said width adjustment assembly includes a closing fork.

15. An apparatus as recited in claim 12, wherein said width adjustment assembly includes a positioner.

16. An apparatus as recited in claim 1, further comprising a housing with a grasping opening at said grasping end.

17. An apparatus as recited in claim 1, further comprising a motive device for driving at least one of said positioning actuator and said drive actuator.

18. An apparatus as recited in claim 17, further comprising a trigger to activate said motive device.

19. An apparatus as recited in claim 1, further comprising a housing with a disposal slot; wherein said disposal slot aligns with an embedded element receptacle.

20. An apparatus as recited in claim 1, further comprising a handle.

21. An apparatus as recited in claim 1, wherein said drive actuator is able to move independently of said carriage.

22. An embedded element pulling apparatus having a grasping end, comprising:

a) a pair of linear guides separated by a width, each linear guide having a length and an inner guide surface, said inner guide surface angled to form a closing ramp at the grasping end;

b) a jaw paired with each linear guide, each jaw engaged to follow along said inner guide surface to grasp and un-grasp the embedded element;

c) a positioning actuator to move said pair of jaws along the length of said linear guides;

d) a drive actuator engaged to close said pair of jaws; and e) a motive device engaged to move said positioning actuator independently of said drive actuator.

23. An apparatus as recited in claim 22, wherein said linear guides are two parallel linear guides.

24. An apparatus as recited in claim 22, wherein said linear guides are two symmetric linear guides.

25. An apparatus as recited in claim 22, further comprising a width adjustment assembly for adjusting the width between said pair of linear guides.

26. An apparatus as recited in claim 25, wherein said width adjustment assembly includes diagonal guide elements.

27. An apparatus as recited in claim 25, wherein said width adjustment assembly includes a closing fork.

28. An apparatus as recited in claim 25, wherein said width adjustment assembly includes a positioner.

29. An apparatus as recited in claim 22, further comprising a lock assembly integrated to lock and unlock said jaws.

30. An apparatus as recited in claim 22, wherein each jaw includes an interchangeable grasping tooth.

31. An embedded element pulling apparatus having a grasping end, comprising:

a pair of jaws, each jaw symmetrically cooperatively closeable upon one embedded element, said pair of jaws engaging the embedded element from opposite sides, each jaw includes an interchangeable grasping tooth, each jaw has a tooth slot, and each grasping tooth has a tooth guide that fits within said tooth slot;

wherein said grasping tooth has a tooth width, a tooth grasping end and a generally arched shape that thins towards said tooth grasping end; and wherein said grasping tooth includes a tooth guide that extends beyond said width of said grasping tooth.

32. An apparatus as recited in claim 31, further including a tooth fastener connecting said grasping tooth to said jaw.

33. An apparatus as recited in claim 32, wherein said tooth fastener passes within a tooth fastener opening in both said jaw and tooth.

34. An apparatus as recited in claim 31, wherein said grasping tooth at the grasping end has a shank notch.

35. An apparatus as recited in claim 31, further comprising a width adjustment assembly for adjusting the width of said jaws.

36. An apparatus as recited in claim 35, wherein said adjustment assembly includes at least on pair of diagonal guide elements, wherein said diagonal guide elements include a fixed guide and a mobile element that is constrained to move relative to said fixed guide.

37. An apparatus as recited in claim 36, further including a closing fork in cooperation with a positioner to change the width of said jaws.

* * * * *